United States Patent [19]

Anderson

[11] Patent Number: 4,803,404

[45] Date of Patent: Feb. 7, 1989

[54] ENVELOPE FOR SMALL HIGH-INTENSITY-DISCHARGE ELECTRODELESS ARC LAMP

[75] Inventor: John M. Anderson, Scotia, N.Y.

[73] Assignee: General Electric Company, Schenectady, N.Y.

[21] Appl. No.: 138,006

[22] Filed: Dec. 28, 1987

[51] Int. Cl.[4] ..... H01J 61/33; H05B 41/24

[52] U.S. Cl. ..... 313/634; 315/248

[58] Field of Search ..... 313/634; 315/248

[56] References Cited

U.S. PATENT DOCUMENTS

| | | | |
|---|---|---|---|
| 3,319,119 | 5/1967 | Rendina | 315/248 |
| 4,070,603 | 1/1978 | Regan et al. | 315/248 |
| 4,480,213 | 10/1984 | Lapatovich et al. | 315/248 |
| 4,636,687 | 1/1987 | Keeffe et al. | 313/634 X |
| 4,705,987 | 11/1987 | Johnson | 313/634 |

FOREIGN PATENT DOCUMENTS

| | | | |
|---|---|---|---|
| 0151166 | 9/1982 | Japan | 313/634 |

*Primary Examiner*—Palmer C. DeMeo

*Attorney, Agent, or Firm*—Geoffrey H. Krauss; James C. Davis, Jr.; Marvin Snyder

[57] ABSTRACT

An envelope, containing a torus-shaped arc of a high-intensity-discharge electrodeless arc lamp has a shape, in a vertical plane, with a sidewall formed of a truncated conical portion, with apex located in a downward position with respect to the cone portion utilized. The upper and lower enclosing surfaces are of convex form and are smoothly joined to the truncated conical side wall of the envelope. In one presently preferred embodiment, the sidewall has a dual truncated conical form, with each truncated cone section having an apex located outside of the arc envelope and with the larger diameter section ends joined together, to allow the lamp to operate either with a base-down or a base-up disposition.

11 Claims, 3 Drawing Sheets

ENVELOPE FOR SMALL HIGH-INTENSITY-DISCHARGE ELECTRODELESS ARC LAMP

BACKGROUND OF THE INVENTION

The present application relates to high-intensity-discharge (HID) electrodeless arc lamps and, more particularly, to a novel arc envelope having a more uniform temperature distribution and reduced susceptibility to temperature-induced damage.

It is now well known that HID electrodeless arc lamps, while providing reasonable efficacy, suffer from a number of problems, including convection of internal gas during operation, with subsequent non-uniform, and often excessive, heating of the arc envelope. This non-uniform envelope heating may allow envelope damage to occur. It is highly desirable to provide an arc envelope with a configuration reducing the heating of that envelope by the toroidal plasma arc contained therein.

BRIEF SUMMARY OF THE INVENTION

In accordance of the invention, the torus-shaped arc of a high-intensity-discharge electrodeless arc lamp is contained within an envelope of substantially transparent material, which envelope has a shape, in a vertical plane, formed of a truncated conical portion, with apex located in a downward position with respect to the slanted sidewall of the cone portion utilized. Preferably, the upper and lower enclosing surfaces are of outwardly convex form and are smoothly joined to the truncated conical sidewall of the envelope.

In one presently preferred embodiment, the sidewall has a dual truncated conical form, with each truncated cone section having an apex located outside of the arc envelope and with the larger diameter section ends joined together, to allow the lamp to operate either with a base-down or a base-up orientation.

Accordingly, it is one object of the present invention to provide a novel envelope for containing an electrodeless arc discharge and having reduced heating by the contained discharge arc.

This and other objects of the present invention will become apparent upon a reading of the following detailed description of the invention, when considered in conjunction with the associated drawing figures.

DETAILED DESCRIPTION OF THE INVENTION

Figure 1:
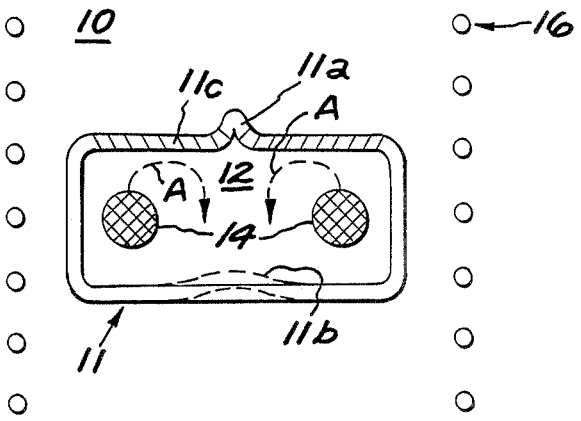
FIG. 1 (PRIOR ART)
FIG. 1 is a vertical cross-sectional view of an electrodeless high intensity discharge lamp having a prior arc envelope configuration.

Referring first to FIG. 1, a prior art electrodeless high-intensity-discharge (HID) lamp 10 (such as is described in U.S. Pat. No. 4,705,987, issued Nov. 10, 1987 and incorporated herein in its entirety by reference) has an evacuated and hermetically-sealed arc envelope 11 which is in the form of a substantially cylindrical tube of optically transparent material. An outer jacket (not shown), also formed of an optically transparent material, can be provided to protect the arc envelop 11 from cooling by convection and also for thermally isolating the arc envelope 11 from an adjacent radio-frequency (RF) excitation coil 16. The arc envelope, typically fabricated of quartz and in a pillbox shape, may have, opposite its top surface 11*a*, an upwardly-convex portion 11*b* for decreasing condensation of arc ingredients 12 filling the arc envelope interior. The light-producing arc 14 is typically an RF-induced plasma of toroidal shape, lying in the horizontal plane. The arc discharge 14 is excited by a coil 16, typically of solenoidal shape. Because the arc envelope is filled with approximately 200 Torr pressure of xenon gas, in addition to other ingredients, there is appreciable gas density and hot gas typically flows by convection during operation. The core of arc discharge 14 may be isothermal at about 5000° K., such that the heated gas rises in the graity field, and following arcuate paths, indicated by arrows A, tends to flow into that region of the arc envelope top 11*a* upwardly and inwardly adjacent of arc 14, and then circulate down the middle of the envelope and eventually back to the bottom of the discharge 14. While, the upwardly-directed convex portion 11*b* prevents arc ingredient condensation at this lower and cooler portion of the volume within the arc envelope, it will be seen, however, that an appreciable (shaded) portion 11*c* of the arc envelope top wall 11*a* receives much more of the arc energy, by contact with the convecting gas 12, and is heated to a temperature greater than the remainder of the arc envelope; this great temperature gradient often causes the arc envelope to be damaged.

Figure 2:
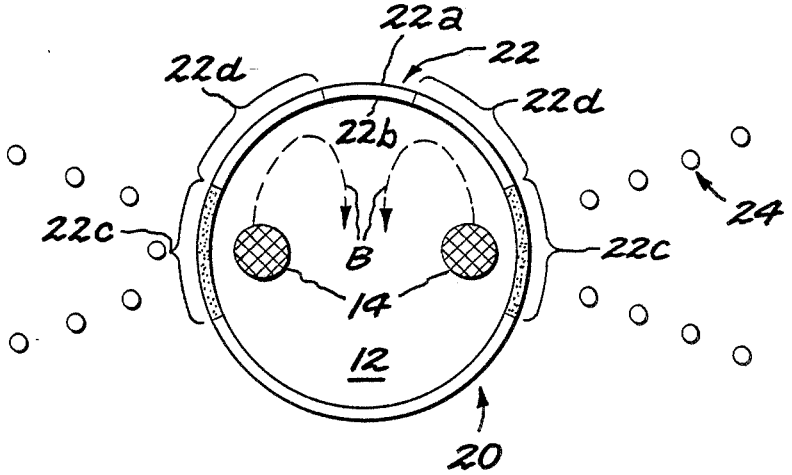
FIG. 2 is a vertical cross-sectional view of a HID discharge lamp having an arc envelope of spherical cross section.

As shown in FIG. 2, I have tested a lamp 20 with an arc envelope 22 of substantially spherical shape. A vee-contour excitation coil 24 (disclosed and claimed in co-filed application Ser. No. 138,005 assigned to the assignee of the present invention, co-filed on the same date as the present application, and incorporated herein in its entirety by reference) is adjacent to, but not in abutment with, the arc envelope exterior surface 22*a*. The interior surface 22*b* encloses the substantially gaseous material 12 in which arc 14 is formed. The arc still forms a torus, whose cross-section is substantially circular, or somewhat elliptical (with long axis vertically disposed). Gas 12 appears to convect upward out of the arc, and reverses direction, as shown by arrows B, someplace near the top of the sphere, so that the cooling gas goes down through the center of the sphere and back to the bottom of the arc. This gas convection apparently provides good mixing of the components of the arc-sustaining gas 12 and contributes to the high luminous efficacy. However, that portion 22*c* of the envelope disposed about the middle horizontal plane of the sphere, and in close proximity to arc discharge 14, is most strongly directly heated by the arc; another ring portion 22*d* of the arc envelope is actually the hottest portion of the envelope, due to the rising heated gases near the top of the gas convection curves D. The hot gases, by visual observation, generally keep the topmost envelope surfaces clear of any condensed ingredient. Also by observation, a ring of damage on the inside of the quartz envelope occurs at that portion of the arc envelope nearest to the arc, especially when a HID lamp is operated at high power input. The visually observed damage of the quartz body is presumed to be formed by at least one sodium silica glass; the arc envelope structural integrity is compromised in this configuration.

Figure 3:
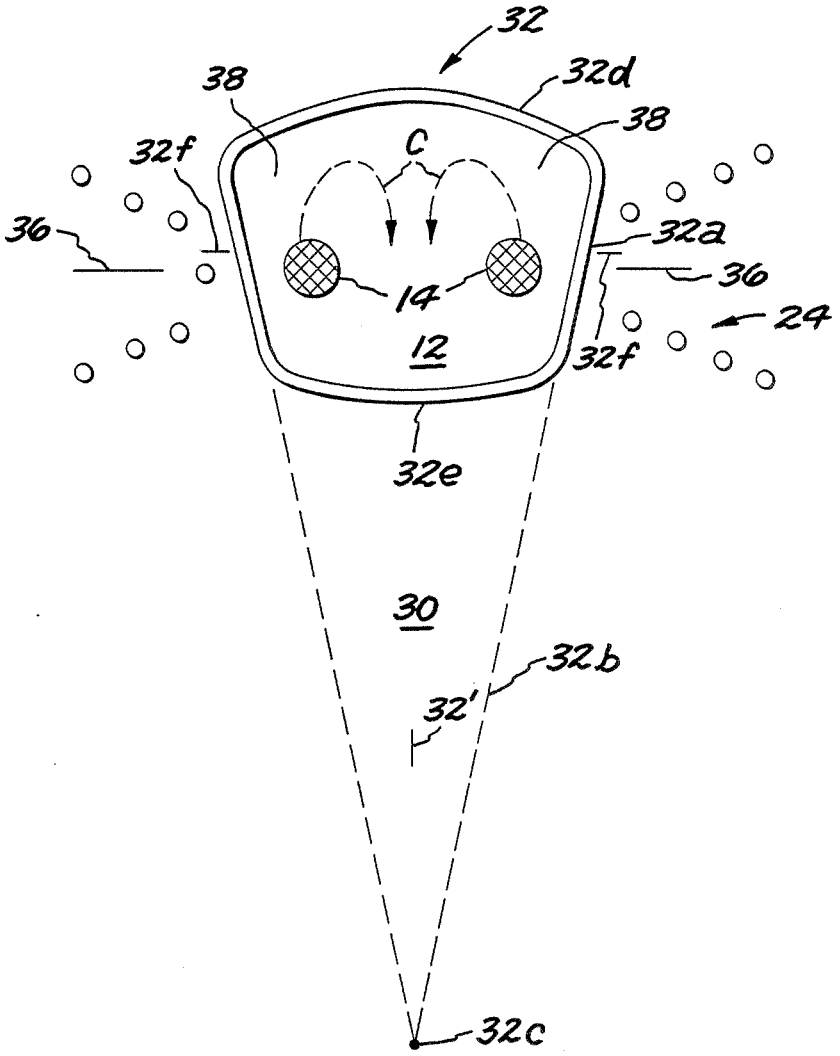
FIG. 3 is a vertical cross-sectional view of a HID arc discharge lamp having an arc envelope with a sidewall of truncated conical shape, in accordance with another principle of the present invention.

In accordance with the invention, a lamp 30 (FIG. 3) has one presently preferred embodiment of an arc envelope 32 with reduced temperature stress. The arc envelope has a sidewall, or central, portion 32*a* which is in the form of a truncated section of an imaginary cone 32*b* having an apex 32*c* outside of, and below, the arc envelope 32. Thus, the arc envelope truncated conical portion, or section, 32*a* has a substantially circular cross section, about cone centerline 32' and in a plane substantially parallel to a midplane 36 (forming the central having a top plane of the excitation coil 24), and with the larger diameter end of the sloping sidewall portion generally in an upward position. The larger diameter end of the arc envelope is covered by a first, or upper, envelope end section 32*d* which is generally concave when viewed from the envelope interior, while the lower, lesser-diameter end of thesloped wall section 32*a* is enclosed by a downward, or bottom, end section 32*e* with a generally concave shape also when viewed from the interior of the envelope. The upper and lower generally curved end sections 32*d* and 32*e*, respectively, are smoothly joined to the sloping sidewalls of portion 32*a* in manner so as to form a hermetically-sealed interior volume in which the arc-sustaining material 12 is enclosed. The RF excited arc torus 14 is formed with its plane substantially in the excitation coil midplane 36, which plane 36 is at, or slightly below, the middle plane 32*f* of the slanted wall portions 32*a*. Thus, the inner arc envelope wall is relieved away from the arc and that interior volume region 38 immediately above the arc, so that hot gases leaving the arc actually move away from the arc envelope walls. Therefore, the amount of arc envelope wall heating by the hot gases immediately leaving the arc torus 14 is not only of reduced magnitude, but is more uniform. The hot gas, convecting generally as shown by arrows C, is also further from the arc envelope top section 32*d*, to reduce the upper portion temperature. The result is a more uniform arc envelope temperature distribution for a given power dissipation in the arc discharge.

Figure 4:
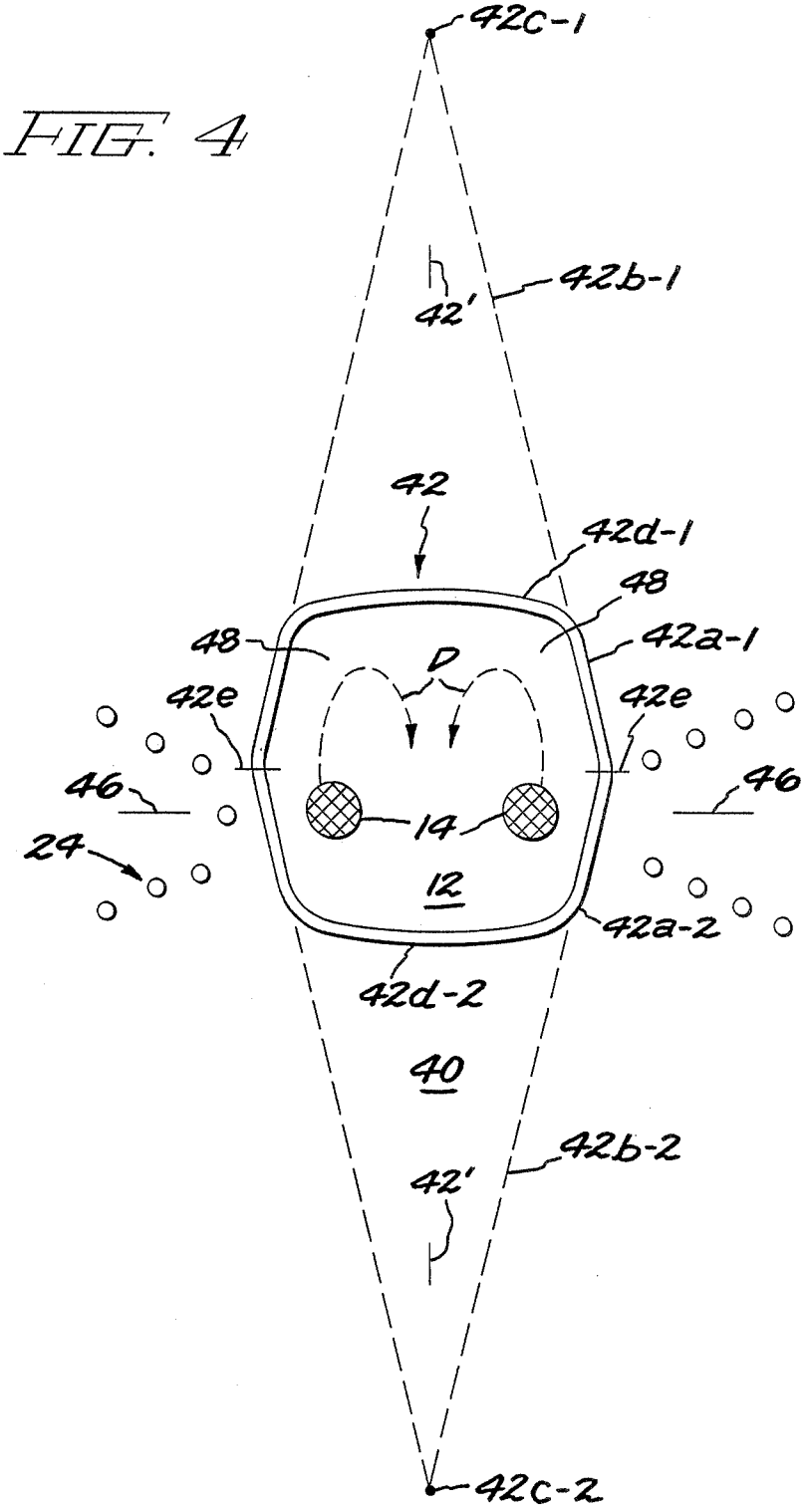
FIG. 4 is a vertical cross-sectional view of a HID arc discharge lamp having an arc envelope with a sidewall of joined truncated conical sections, in accordance with another principle of the present invention.

Referring now to FIG. 4, another presently preferred embodiment of HID lamp 40 has an arc envelope 42 in which the entire intermediate portion 42*a* is comprised of a pair of truncated conical sections 42*a*-1 and 42*a*-2, with the larger diameter ends thereof in abutment and the smaller diameter ends thereof opposed from one another. Thus, a first, upper slanted wall portion 42*a*-1 is formed by a portion of an imaginary cone 42*b*-1 having a center 42*c*-1 disposed generally upwardly beyond a upper capping portion 42*d*-1 of the arc envelope (and advantageously along the vertical centerline 42' of the envelope). Similarly, a second, lower slanted wall portion 42*a*-2 is formed as a portion of an imaginary cone 42*b*-2 having a center 42*c*-2 disposed generally downwardly beyond a bottom capping portion 42*d*-2 of the arc envelope (and also advantageously along envelope centerline 42'). The arc-discharge-exciting RF coil means 24 has a central plane 46, which is also the plane through the center of the toroidal discharge arc, situated below the central, preferably substantially circular, plane 42*e* of the arc envelope wall at its maximum diameter. Thus, there is again a volume 48 above the arc 14 and having at least a portion thereof with a greater radius then the radius of arc discharge 14; in this volume 48 the arc envelope walls are relieved generally away from the flow of hot gases, as generally shown by arrows D, so that the arc envelope walls 42*a* and cap portions 42*d* are at lower and more uniform distributed temperatures for a given power dissipated in arc 14. Arc envelope 42 is specifically constructed with two truncated conical wall portions 42*a*, pointing in opposite directions (generally upwardly and downwardly), to allow the resulting lamp 40 to be mounted with its base in either an upward or downward configuration, to allow base-up or base-down operation of the lamp. That is, turning arc envelope 42 upside down, with respect to at least the excitation coil 24, presents substantially the same configuration of the arc envelope.

While several presently preferred embodiments of my novel HID electrodeless lamp envelope, with more uniform temperature distribution, have been described herein, many modifications and variations will now become apparent to those skilled in the art. For example, the envelope can be fabricated of a substantially transparent or translucent material, as required, including, but not limited to, quartz, a crystalline alumina (such as sapphire), a polycrystalline alumina (such as Lucalox®) and the like. It is my intent, therefore, to be limited only by the scope of the appending claims and not by the specific details and instrumentalities.

What I claim is:

1. An envelope of substantially transparent material for containing a gaseous arc-sustaining medium, comprising: a central portion formed of first and second slanted sidewalls each having a shape generally defined by a section of a cone having an apex located outside of said envelope and upon an opposite side of said envelope from the apex for the other one of the pair of sidewalls, each of said conical sections being truncated by opposed first and second endplanes, said first endplanes being larger than said second endplanes, and with the first endplanes of both of the first and second sidewalls being hermetically joined to each other; a first end portion substantially hermetically enclosing the second endplane of the first sidewall; and a second end portion substantially hermetically enclosing the second endplane of the second sidewall.

2. The envelope of claim 1, wherein the second endplanes of the first and second sidewalls are substantially parallel to one another.

3. The envelope of claim 2, wherein the substantially parallel second endplanes are also substantially perpendicular to a common rotational centerline of the sidewall portions.

4. The envelope of claim 1, wherein at least one of the first and second end portions is of concave shape, as viewed from the envelope interior.

5. The envelope of claim 1, wherein the envelope is fabricated of a selected one of quartz, crystalline alumina and polycrystalline alumina.

6. An electrodeless high-intensity-discharge (HID) arc lamp, comprising an envelope of substantially transparent material having (a) first and second slanted sidewalls each with a shape generally defined by a section of a cone having an apex located outside of said envelope and upon an opposite side of said envelope from the apex for the other one of the pair of sidewalls, each of said conical sections being truncated by opposed first and second endplanes, said first endplanes being larger than said second endplanes, and with the fist endplanes of both of the first and second sidewalls being hermetically joined to each other, (b) a first end portion substantially hermetically enclosing the first sidewall second endplane; and (c) a second end portion substantially hermetically enclosing the second sidewall second endplane; a gaseous arc-sustaining medium filling the envelope; and radio-frequency means for generating a light-emitting toroidal arc within the envelope.

7. The lamp of claim 6, wherein the first and second endplanes of both said first and second sidewalls are all substantially parallel to one another.

8. The lamp of claim 7, wherein the arc has a central plane which is substantially horizontal and not high than the joined first enplanes.

9. The lamp of claim 8, wherein the substantially parallel endplanes are also substantially perpendicular to a common rotational centerline of the sidewalls.

10. The lamp of claim 6, wherein the envelope is fabricated of a selected one of quartz, crystalline alumina and polycrystalline alumina.

11. The lamp of claim 6, wherein at least one of the second end portions is of concave shape, as viewed from the envelope interior.

* * * * *